US005181472A

United States Patent [19]

Scheuchzer

[11] Patent Number: 5,181,472

[45] Date of Patent: Jan. 26, 1993

[54] DEVICE FOR THE SUBSTITUTION OF THE RAILS OF RAILWAY TRACKS

[75] Inventor: Antoine P. Scheuchzer, Epalinges, Switzerland

[73] Assignee: Les Fils d'Auguste Scheuchzer S.A., Lausanne, Switzerland

[21] Appl. No.: 727,600

[22] Filed: Jul. 9, 1991

[30] Foreign Application Priority Data

Jul. 13, 1990 [CH] Switzerland ..... 2351/90
Jun. 25, 1991 [CH] Switzerland ..... 1868/91

[51] Int. Cl.[5] ..... E01B 29/02
[52] U.S. Cl. ..... 104/2
[58] Field of Search ..... 104/2, 5

[56] References Cited

U.S. PATENT DOCUMENTS

| | | | |
|---|---|---|---|
| 3,451,470 | 6/1969 | Herrick | 104/2 |
| 3,521,565 | 7/1970 | Plasser et al. | 104/2 |
| 3,566,796 | 3/1971 | Herrick | 104/2 |
| 3,896,734 | 7/1975 | Plasser et al. | 104/2 |
| 3,999,276 | 12/1976 | Brown et al. | 104/2 |
| 4,301,738 | 11/1981 | Theurer | 104/2 |
| 4,393;784 | 7/1983 | Theurer | 104/2 |

FOREIGN PATENT DOCUMENTS

| | | | |
|---|---|---|---|
| 0004985 | 9/1981 | European Pat. Off. . | |
| 0019984 | 2/1984 | European Pat. Off. . | |
| 933855 | 6/1982 | U.S.S.R. | 104/2 |

*Primary Examiner*—Robert J. Oberleitner
*Assistant Examiner*—Kevin D. Rutherford
*Attorney, Agent, or Firm*—Wegner, Cantor, Mueller & Player

[57] ABSTRACT

The new rails to be laid are heated continuously in order to be neutralized. For this purpose, they are raised and exposed to a source of heat in the form of two heating tunnels which are mounted on a vehicle running in a continuous manner on the old rails. Each heating tunnel is traversed by a stretch of new rail. Simultaneously, the old rails are detached from the sleepers, and, after the passage of the vehicle, are deposited along the track or are cleared away. The heating vehicle is followed by an assembly vehicle by means of which the new rails, brought to and maintained at the temperature of neutralization, are laid continuously on the sleepers and are fastened thereto. In front of the heating vehicle, there is provided, on the old track, a welding vehicle for welding the new rails.

11 Claims, 14 Drawing Sheets

DEVICE FOR THE SUBSTITUTION OF THE RAILS OF RAILWAY TRACKS

FIELD OF THE INVENTION

The invention relates to a process and a device for the substitution of the rails of railway tracks.

PRIOR ART

Until now the substitution of the rails only, while keeping the same sleepers, has represented a lengthy task which was carried out for the most part by manual operations and which required a great deal of time. To substitute the rails, in fact, it is necessary first of all that the old rails should be detached from the sleepers, moved to the side of the track and cleared away. Then the new rails, previously deposited along the track, have to be laid and fastened onto the sleepers.

Subsequently there takes place the operation called "neutralisation" of the new rails. The object of this neutralisation is to fix the rails in a condition of least expansion, either at a specified average temperature (for example 25° C.) when the neutralisation takes place by heating of the rails, or with a distension of the rails corresponding to their expansion at this average temperature when the neutralisation operation is carried out by distension of the rails. By virtue of the neutralisation of the rails, there is a considerable reduction in the risks of breaking of the said rails in cold weather or of distortion on hot days.

The heating of the new rails laid on the sleepers is usually carried out by means of hot air blowers, which have to be moved regularly on the track, the two stretches of rails being treated simultaneously. Usually the heating is effected in several passes going from the free end of the continuous lengths of rails towards the fixed point and coming back in the reverse direction. During the heating, the rails are slightly raised from their supports to permit them to extend freely between the point of heating and the free end of the continuous lengths of rails. As soon as the prescribed extension is obtained, it is necessary to proceed to the tightening of the fastenings. Measurement of the temperature of the rails is carried out by means of at least two magnet thermometers, and this measurement must last five minutes at least. However, such measurements do not give very accurate results.

All these manipulations executed step by step, by portion of rails, rail after rail or long length of rail after long length of rail, demand a great deal of time. Until the present time, these manipulations have not been the subject of any mechanisation. The trains for renewal of the railway tracks, as for example those which are described in the documents EP-B-4985 and EP-B-19984, are designed to replace not only the rails, but also the sleepers and the ballast, and comprise no facility for the neutralisation of the new rails.

SUMMARY OF THE INVENTION

The object of the present invention is to create a process and a device for the mechanised substitution and neutralisation of the rails.

To attain this object, the process according to the invention is characterised in that:

the new rails, previously brought to the site, are heated continuously in order to be neutralised, the rails being for this purpose raised up and exposed to a source of heat which is moved in a continuous manner, the old rails are detached from the sleepers and deposited along the track or are cleared away, the new rails, brought to and maintained at the temperature of neutralisation, are laid continuously on the sleepers and are fastened thereto.

A device for the implementation of this process is characterised in that it comprises a train composed of at least two work units running on the track one after the other, at a distance that is at least approximately constant, the forward unit being a heating vehicle running on the old rails and comprising:

at least one heating tunnel which is intended to be traversed by the new rails during the advance of the train in order to neutralise them and means for measuring and controlling the temperature of the new rails;

at the front, means for gripping the new rails, previously brought to the site, to introduce them into the said tunnel;

stations for releasing the old rails from the sleepers;

means for guiding the old rails that are detached; the rear unit being an assembly vehicle running on the new rails laid upon the sleepers and comprising:

at the front, a cantilevered frame supplied with means for guiding and for laying the new rails on the sleepers, as well as working stations for fastening to the sleepers the new rails brought to the desired temperature.

The essential advantage of the invention is to permit, in a single process, both the substitution and the neutralisation of the rails, this being done in a mechanised manner, which brings significant savings in time and labour.

Other advantages of the invention result from the fact that the heating operation may easily be carried out by high-frequency induction and takes place continuously, while the new rails to be heated are not at all accommodated in the fastenings of the sleepers. Thus removed from the track, the new rails may be more easily exposed to the source of heat. Moreover, they "float" freely, which permits the expansion of the metal to be carried out without constraints. The proposed system for continuous heating has, furthermore, the advantage of not requiring longitudinal transport of the treated rails: it is the train for substitution for which advances, while th new rails are only raised up. The heating as well as the temperature of the treated rails may respectively be controlled and measured much more easily and in a more accurate manner than directly on the track according to the non-mechanised current systems. Another advantage of the invention stems from the fact that during the heating of the new rails, the old rails are detached and released, which makes a further saving in time.

The invention permits the substitution and the neutralisation of the rails at an average speed of the order of 300 m to 400 m per hour, during the few allocated hours at night, therefore over approximately 1.5 to 2 km per night.

BRIEF DESCRIPTION OF THE DRAWINGS

The invention will be described by means of the embodiments of the device by reference to the attached drawings.

FIGS. 11*a* to 13*a* are plan views of the track to illustrate the positions of the old rails R1 and of the new rails R2 and their lateral displacement during the substitution, as well as some components of the vehicles according to FIGS. 11 to 13.

DESCRIPTION OF THE PREFERRED EMBODIMENTS

Figure 1:
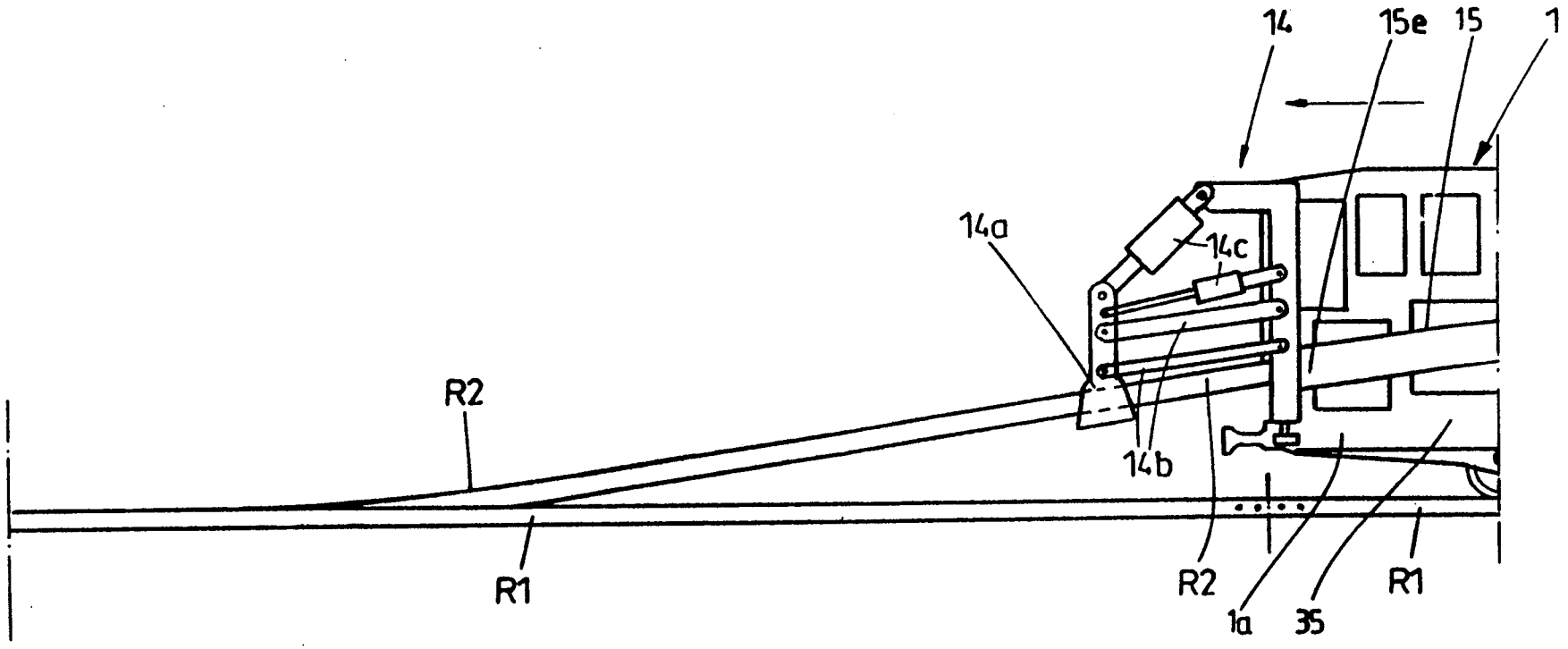
FIGS. 1 to 5 show a first device formed by a train for substitution and for neutralisation of the rails, represented in five successive parts.
Figure 2:
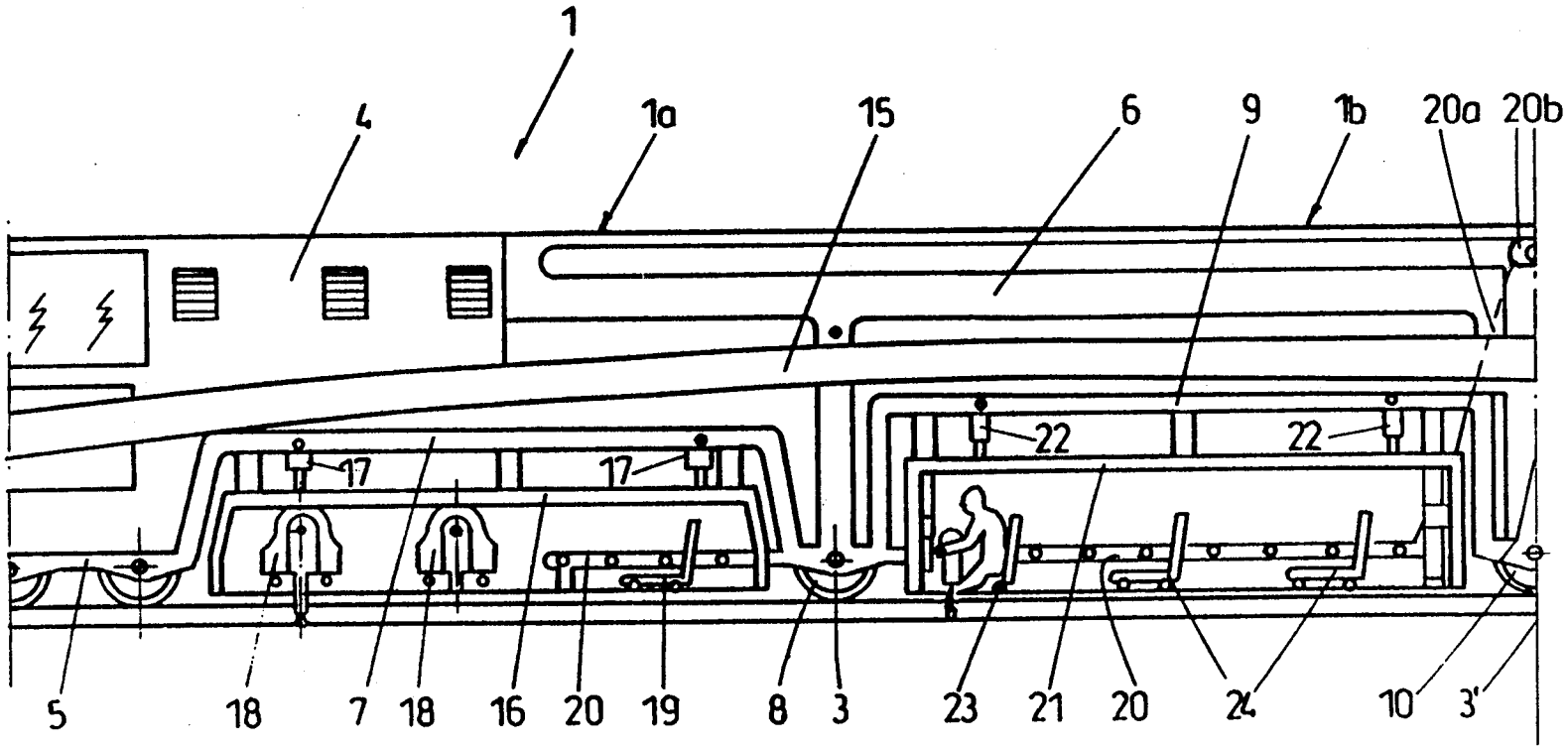

The device formed by a train for substitution and for neutralisation of the rails, according to FIGS. 1 to 5, is designed to remove the old rails R1 from a track and to lay in their place new rails R2 which are neutralised. The new rails R2 to be laid are previously disposed on either side of or in the centre of the track, approximately in the place for laying. The operations for depositing the old rails, for heating and for laying the new rails are all carried out continuously, at an average speed of, for example, 300 to 400 m per hour.

According to FIGS. 1 to 5, the train which advances in the direction of the arrow comprises two work units, namely a heating vehicle and, behind the latter, an assembly vehicle 2. Vehicle 1 which runs on the old rails R1 raises up the new rails R2 and heats them, while at the same time detaching the fastenings of the old rails R1. Vehicle 2 which runs on the new rails R2 lays heated new rails R2 while at the same time clearing away the old rails R1. During this substitution, the new rails R2, as with the old rails R1, do not undergo any longitudinal transport but remain, as it were, in place. The train merely raises them up and displaces them in the transverse direction, progressively, relative to the stationary rails.

Vehicle 1 comprises three sections 1*a*, 1*b*, 1*c*, articulated at 3 and 3', which run on a leading bogie 5, intermediate axles 8 and 10, as well as a rear bogie 12. Along the length of this vehicle 1 are installed two heating tunnels 15 in the form of tubes, one tunnel per stretch of rails. These tunnels, principally supported by a frame 6, are slightly curved upwards and therefore are somewhat in the form of a vault having a rise of about 30 to 40 cm. The tubes forming the tunnels 15 are made of a slightly flexible material and/or are articulated.

In a forward compartment provided in the body 4 of the vehicle are located the drive motors and the generators for the heating of the tunnels; at the rear of the vehicle 1 is located a control cabin 13.

At the front of the vehicle 1 are installed means 14 for gripping the new rails R2 in order to catch hold of and to introduce these rails into the forward end 15*e* of the heating tunnels 15. These gripping means comprise rail lifters 14*a* mounted at the end of articulated levers 14*b* and which are adjustable by jacks 14*c*. The new rails R2 are previously welded in order to form a continuous stretch of rails hence joint-free.

For this purpose, long lengths of rails, for example of 108 m, which are composed of three rails welded in the workshop, are placed along the track and these long lengths of rails are gradually welded by machines as the train for substitution approaches. In this manner, it is the two continuous stretches of rails which are introduced into the two heating tunnels 15, where they are heated.

A preheating takes place in the tunnels, in the forward part 35, and a control of the temperature to the desired value of neutralisation is carried out in the part 35' of the tunnels, at the rear of the vehicle 1.

On traversing these tunnels the rails may float on rollers, which permits the metal to expand without constraint. For this purpose, the new rails R2 may be supported or guided by support rollers and/or guide rollers. If necessary, grippers with motorised rollers permit longitudinal displacement thereof, for example in order to adjust them to the old rails at the start of the laying.

Figure 3:
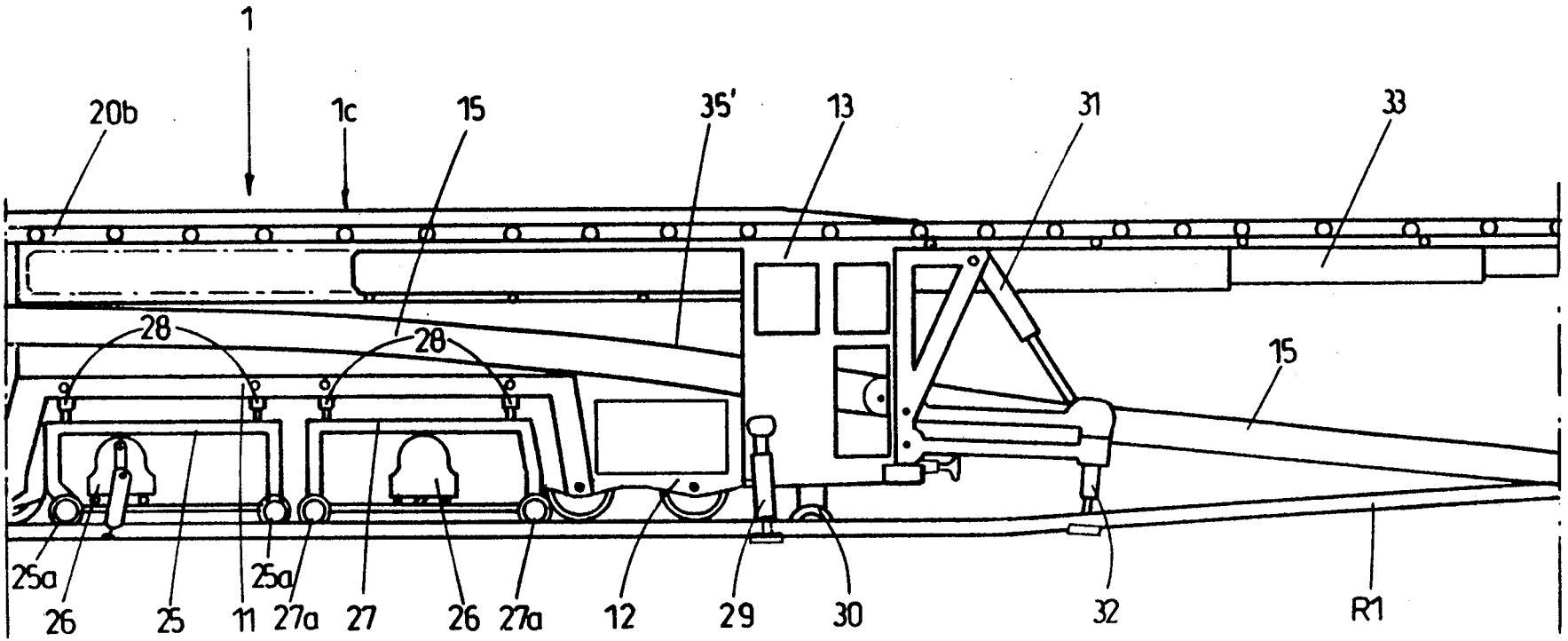
Figure 4:
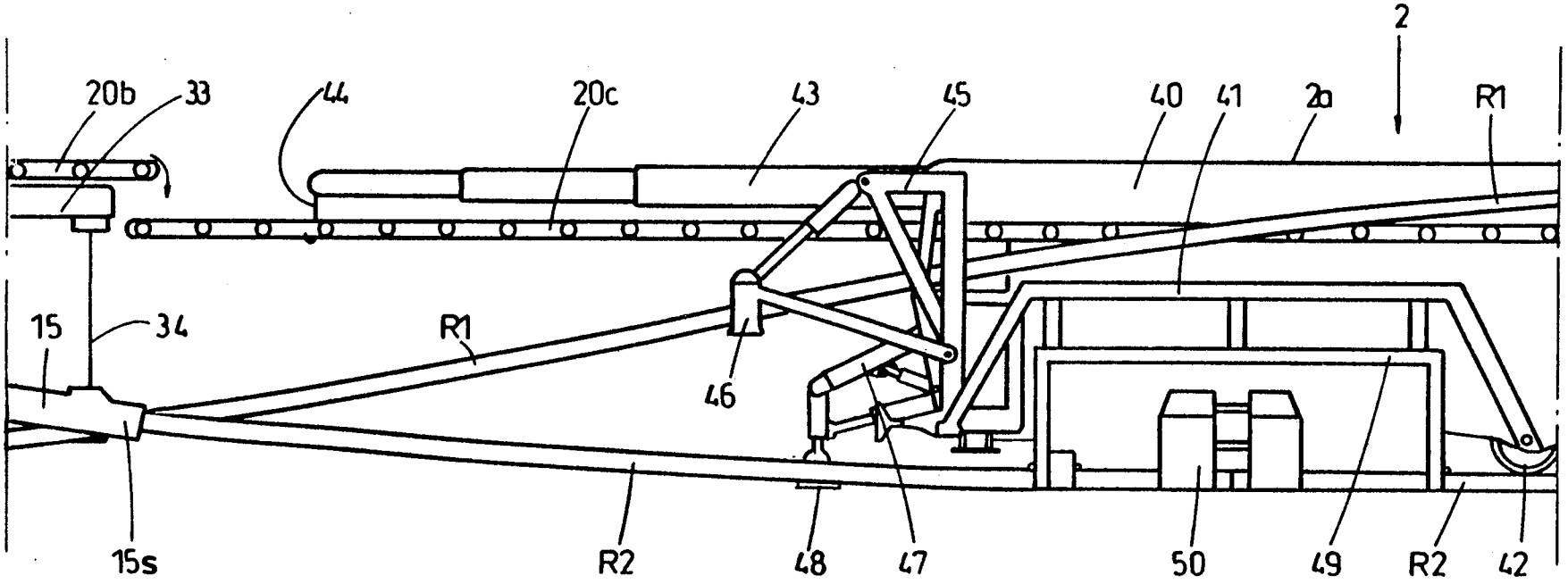
Figure 5:
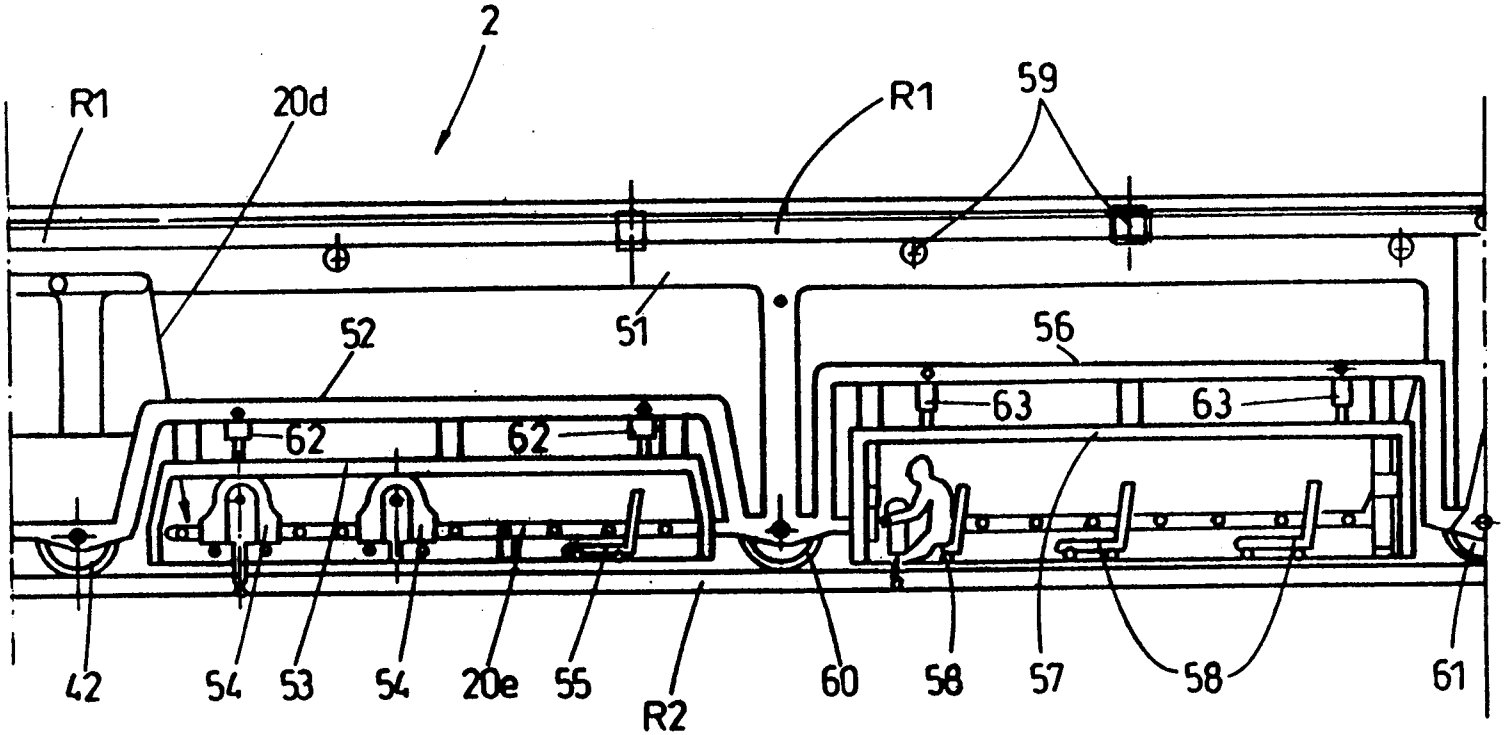
Figure 6:
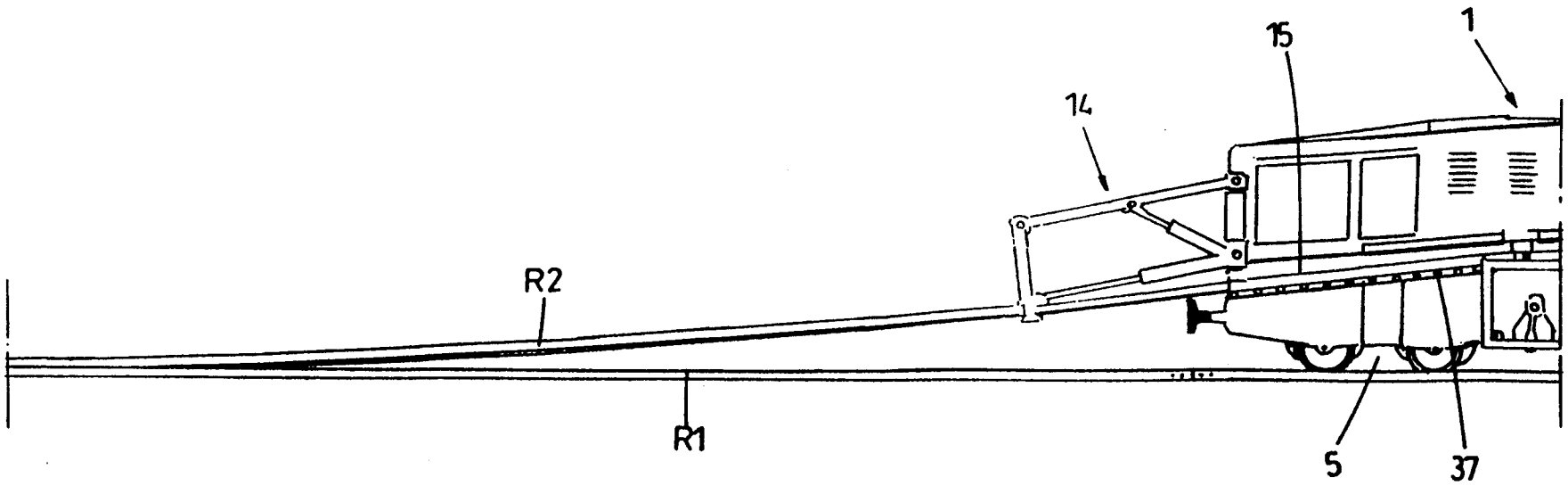
FIGS. 6 to 9 show a second embodiment of such a train.
Figure 7:
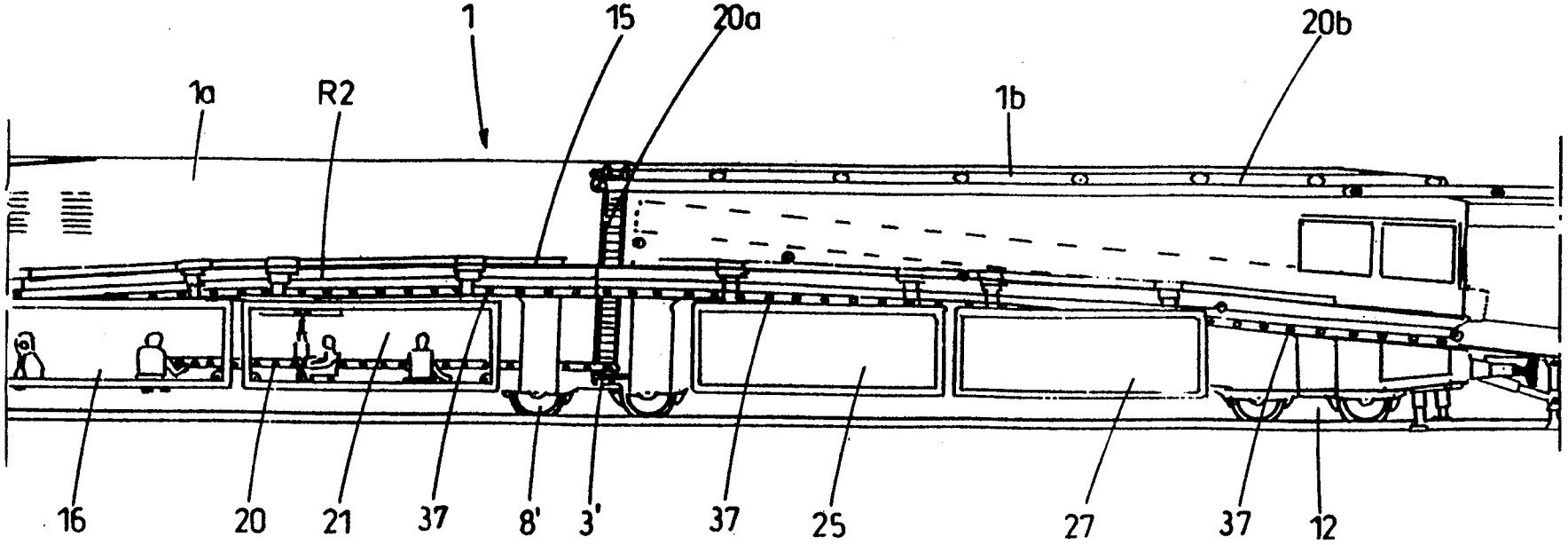
Figure 8:
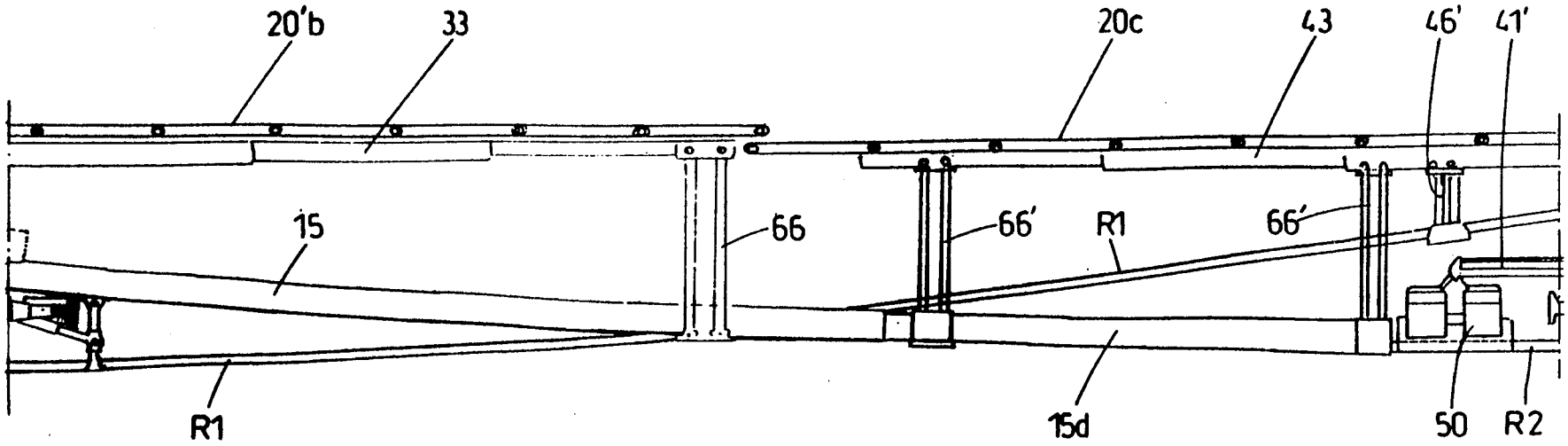
Figure 9:
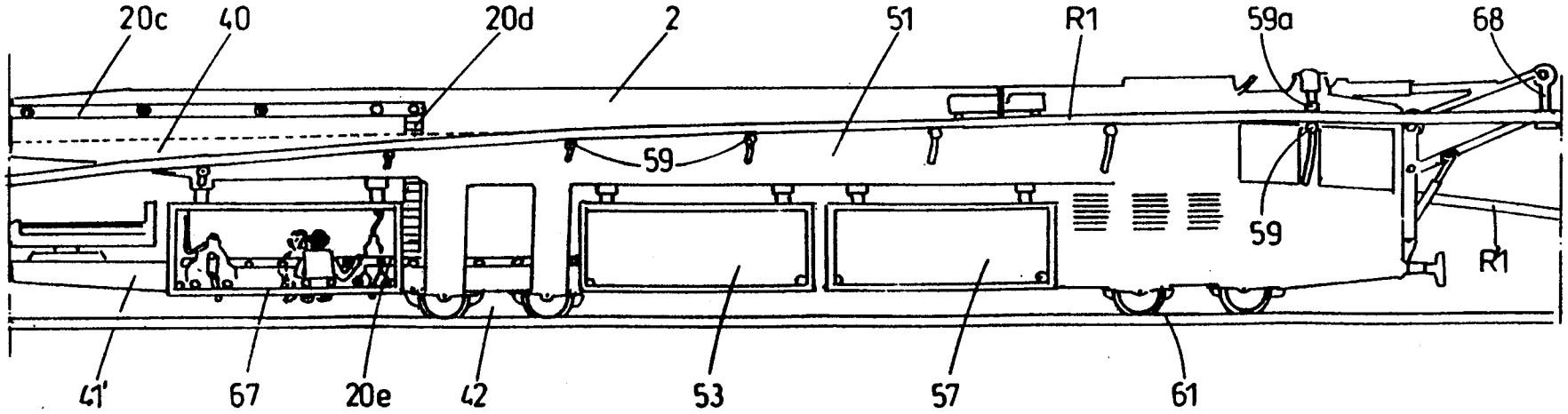
Figure 10:
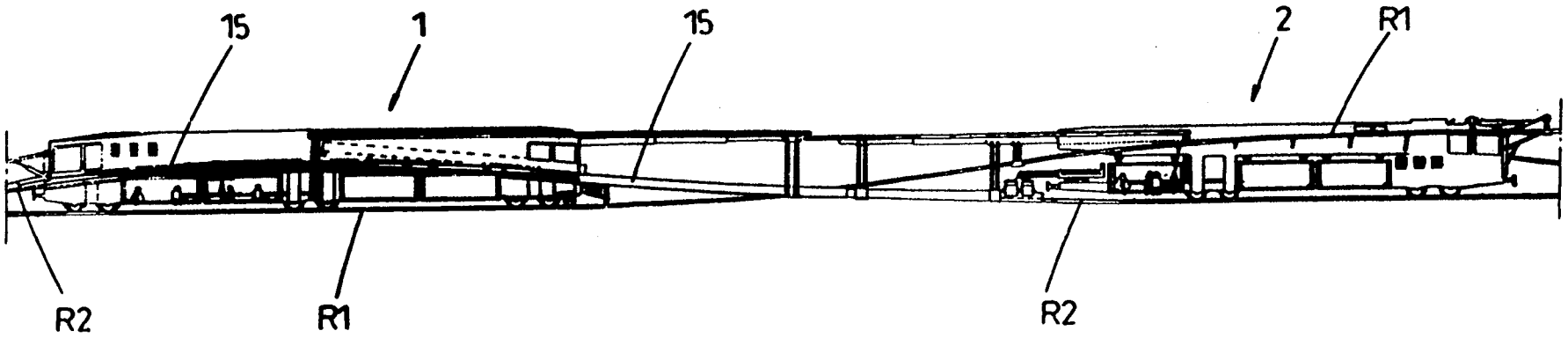
FIG. 10 represents such a train in its entirety.

As illustrated in FIGS. 3 and 4, the rear part of each heating tunnel 15 extends beyond the rear of the vehicle 1 and this rear part is suspended from a telescopic cantilevered beam 33 by a cable 34 which holds the rear end 15*s* of the tunnel where the heated rail R2 exits.

Preferably, the heating in the tunnels 15 is by induction. By creating a great number of magnetic fields enveloping the rail, it is possible to heat it rapidly right to the core, and to control thereby the amount of heating according to the intensity of the current. The temperature of the rail, before and during the heating, is controlled and the intensity of heating is adjusted as a function of the external temperature and of the advance of the machine. In the case of an intermediate stop by the train, the heating is adjusted in order to maintain the desired temperature—in principle 25° C.—whatever may be the duration of the stop. This is done especially after the start of the work if the rear end of the stretches of new rails has passed through the tunnel and is welded to the forward end of the stretches of existing rails, for example of stretches laid the night before. During the production of these first welds, there is a stop for a few minutes. However, it is also possible not to make these welds at that moment and to carry them out subsequently after the fixing of the new stretches of rails onto the sleepers.

The disposition of the heating and guide tunnels takes into account both the space required to detach the old rails R1 and the fact that the new rails R2 will be the more easily disposed without constraint on the sleepers, as they have been moved to a point vertically above their laying position. This means that preferably the heating and guide tunnels will have approximately the same spacing as that of the rails on the track.

Of course it is possible to heat the two stretches of rails in a single heating tunnel. But this saving in the construction has the disadvantage that it is no longer possible to dissociate the control of the temperature of each stretch of rails and that the path of the said rails must be corrected before the laying.

The vehicle 1 serves not only to heat the new rails R2, but also simultaneously to release the old rails R1. These two functions are clearly separated in the actual structure of the machine. While the two heating tunnels 15, somewhat in the form of a vault, extend in the upper portion of the vehicle 1, the work stations for releasing the old rails are provided on platforms 16, 21, 25 and 27 suspended, below the heating tunnels, from the frameworks 7, 9 and 11 in a retractable manner by means of jacks 17, 22 and 28 for the raising and lowering movement. While working, the platforms may run on the track, which makes it possible to ensure, especially on curves, a correct positioning of the units and/or of the tools for detaching and fastening.

On the platforms 16 are located detaching stations with automatic sleeper-screw drivers 18 and movable seats 19 for the workers who remove fastenings or release fixtures. On the platforms 21 are provided movable seats 23 for the manual sleeper-screw driving and movable seats 24 for the manual detaching.

The other platforms 25 and 27 are equipped with automatic detaching apparatuses 26 and are supplied with wheels 25*a*, 27*a* permitting them to rest on the rails on the track, and this considerably facilitates the accurate positioning of these automatic detaching apparatuses, the rise becoming negligible on the curves. The work platforms of the vehicle 1 therefore permit the sleeper-screw-driving and the removal or the release of the fixtures, whether by hand or automatically.

If fastenings must be completely removed, the latter are collected and conveyed from the detaching stations of the vehicle 1 to the fastening stations of the vehicle 2 by means of a transport system composed of several sections, 20, 20*a*, 20*b*, 20*c*, 20*d*, 20*e*, sections 20, 20*b*, 20*c* and 20*e* being horizontal belt conveyors, section 20*a* being a lifting transporter and section 20*d* being a lowering transporter.

After the release of the old rails R1, the latter are caught by rail-guides 29 and rail lifters 32, mounted on an adjustable support 31 at the rear of the vehicle 1 which also comprises spacing and holding stays 30 of the released rails. The disposition of the rail lifters is such that the guiding of the rails operates by the simple advance of the vehicle 1. These old rails are raised up and moved onto the vehicle 2 to be cleared away either directly onto special transport wagons, or to be deposited in the centre of the track or by the side of the latter.

The vehicle 1 comprises, at the rear, a telescopic beam 33 which carries the section 20*b* of the system of transport of the fastenings, as well as the rear end 15*s* of each heating tunnel 15, suspended by a cable 34 and positioned in such a manner that the new rails R2 leaving each tunnel are laid on the sleepers at the places for their fixing.

The assembly vehicle 2 comprises a main framework 51 with a leading bogie 42, an intermediate axle 60 and a rear bogie 61 (shown only partially) and, at the front, a cantilevered frame 40 with a cantilevered telescopic beam 43 as well as a frame 41 likewise cantilevered. The telescopic beam 43 carries the section 20*c* of the system for transport of the fastenings, which section is suspended from hooks 44.

To the frame 40 are fixed an adjustable support 45 supplied with rail-guides 46 for the old rails R1, as well as an adjustable support 47 supplied with rail lifters 48 for the new preheated rails R2 which leave the heating tunnel 15. The old rails R1 are supported and guided on the main framework 51 by rollers 59 either on a horizontal axis or a vertical axis, and are deposited behind the vehicle 2, in the centre or by the side of the track.

By means of the rail lifters 48, the new rails are disposed on the sleepers and are prefastened just before the passage of the bogie 42 at the front of the vehicle 2. The latter is equipped with fastening platforms 53 and 57 analogous to the detaching platforms of the vehicle 1. These platforms 53 and 57, mounted in the frameworks 52 and 56, are likewise retractable by means of jacks 62 and 63, and permit the reception, disposition and securing of the fixtures of the new rails R2, on which the vehicle 2 runs. According to FIG. 5, the platform 53 comprises for example the automatic sleeperscrew drivers 54 and a movable seat 55, while the platform 57 is equipped with a plurality of manual sleeperscrew driving units in the form of movable seats 58.

This work of fastening the new rails R2 is therefore carried out by hand or in an automatic manner. Preferably, the platforms of the vehicles 1 and 2 are equipped with computer-controlled robot-machines, respectively for the detaching and for the automatic fastening of the fixtures of the rails.

The cantilevered framework 41 carries a platform 49 which is retractable and equipped with a welding station 50. This welding unit serves for the first welds which are carried out at the start of the work, just before the installation of the heated new rails R2 in their fastenings on the sleepers, therefore at the front of the vehicle 2.

FIGS. 6 to 10 show diagrammatically a second embodiment of a train for substitution and for neutralisation of the rails.

Only the main parts are indicated by references; the parts corresponding to the parts of the first embodiment of FIGS. 1 to 5 bear the same references and are not described again. The modifications in relation to the first embodiment are the following:

The means 14 for gripping the new rails R2 at the front of the vehicle 1 have another configuration. The vehicle 1 rests on three bogies 5, 8' and 12, and it is articulated in the middle thereof at 3', and therefore comprises only two articulated sections 1*a*, 1*b*; it is likewise supplied with two heating tunnels 15 for heating the new rails R2, and with work platforms 16, 21, 25 and 27 to release the old rails R1. Each heating tunnel 15, represented partially in section in order to show supporting rollers 37 for the new rails, is extended in the critical zone of the crossing of the old and the new rails (FIG. 8) by a section 15*d*, in such a manner that between the movement when the new rail leaves this tunnel and the moment when the fixing of the fastenings locks the heated rail, barely a few minutes elapse.

This section 15*d* of the heating tunnels is suspended from the telescopic beam 43 of the vehicle 2 by means of suspensions 66', while the previous sector of the heating tunnels is suspended from the telescopic beam 33 of the vehicle 1 by suspensions 66.

The vehicle 2 runs on two bogies 42 and 61 and comprises a cantilevered framework 41' from which is suspended the welding station 50, as well as a frame 40, likewise cantilevered, from which is suspended a retractable platform 67 situated in front of the first bogie 42 and which is intended to manipulate the fastenings which arrive on the system for transport of fastenings. The latter comprises seven sections 20, 20*a*, 20*b*, 20'*b*, 20*c*, 20*d* and 20*e*. Furthermore, the platform 67 may serve to fasten by means of a sleeper-screw, just as with the other platforms 53 and 57. As in the first embodiment, the platforms are preferably equipped with computer-controlled robot-machines, for the detaching and automatic fastening of the fixtures of the rails.

To guide the old rails R1, there are provided rail lifters 46' suspended from the telescopic beam 43, support rollers 59 and counter rollers 59*a* as well as rail-guides 68 at the rear of the vehicle 2 to move these rails R1 directly onto special wagons (not shown). Alternatively, these rails, as shown for a rail R'1, may be deposited in the centre of the track.

The heating tunnels do not necessarily have to be continuous tubes, but may have tubular sections which may or may not be articulated. These tubular sections may also be disposed at a distance one from the other, each one comprising a heating unit, and are preferably connected to each other by coverings or sleeves to retain the heat.

Figure 11A:
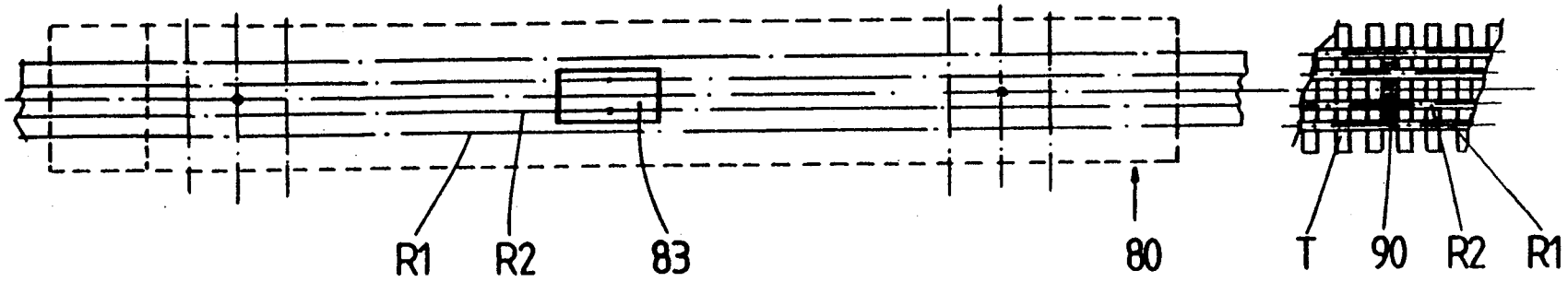
Figure 11:
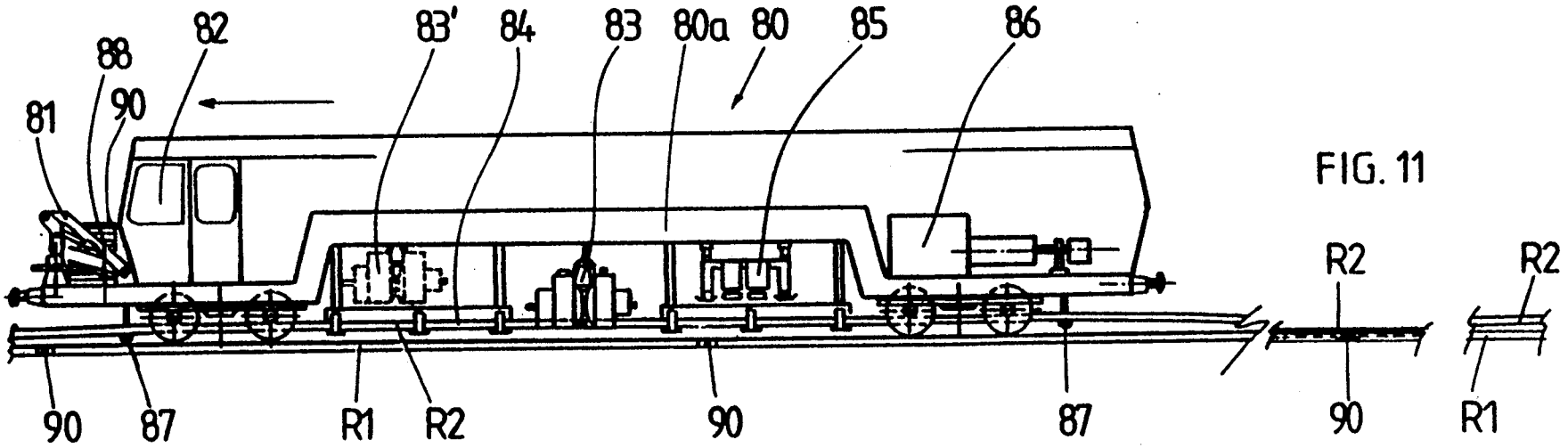
FIGS. 11 to 13 show a third embodiment, completed by a welding vehicle and comprising a preferred form of a heating vehicle.
Figure 12A:
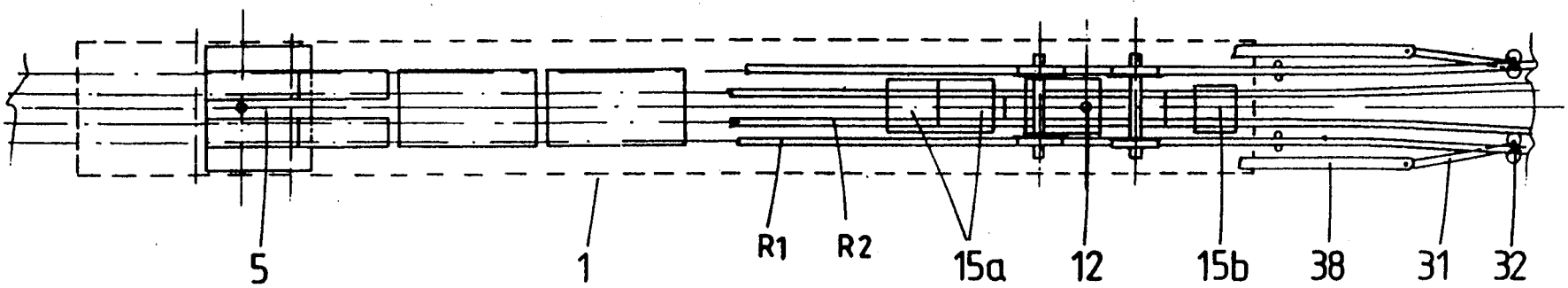
Figure 12:
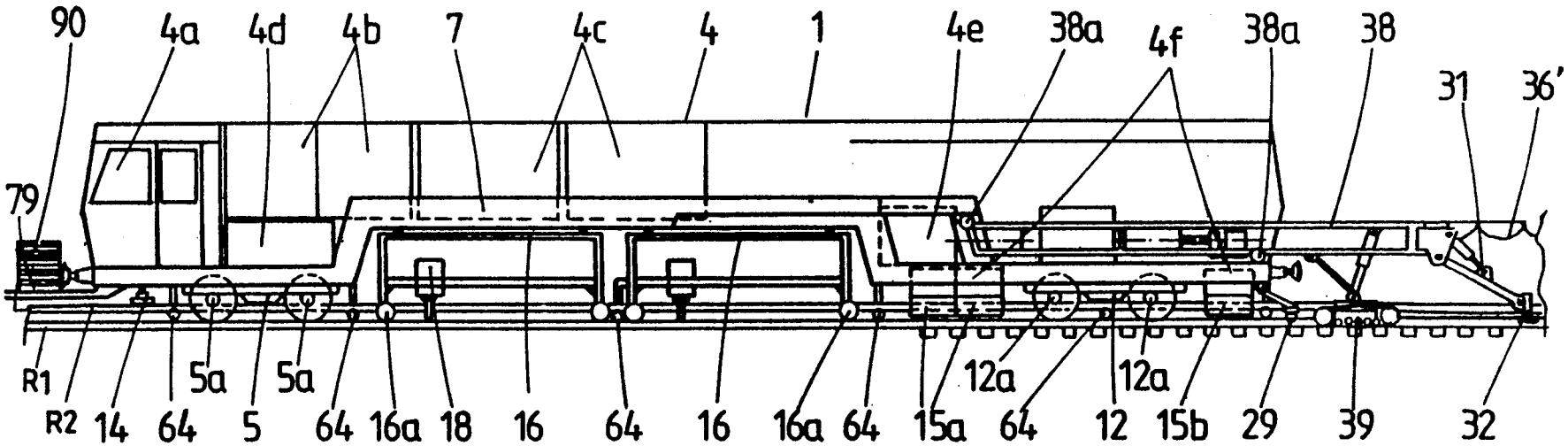
Figure 13A:
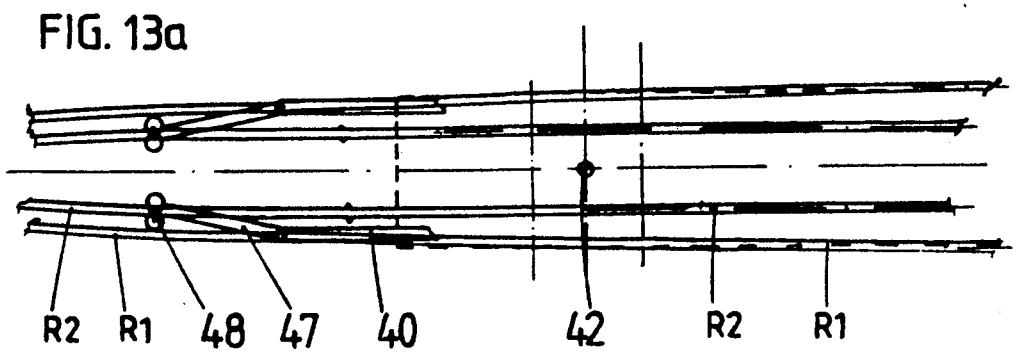
Figure 13:
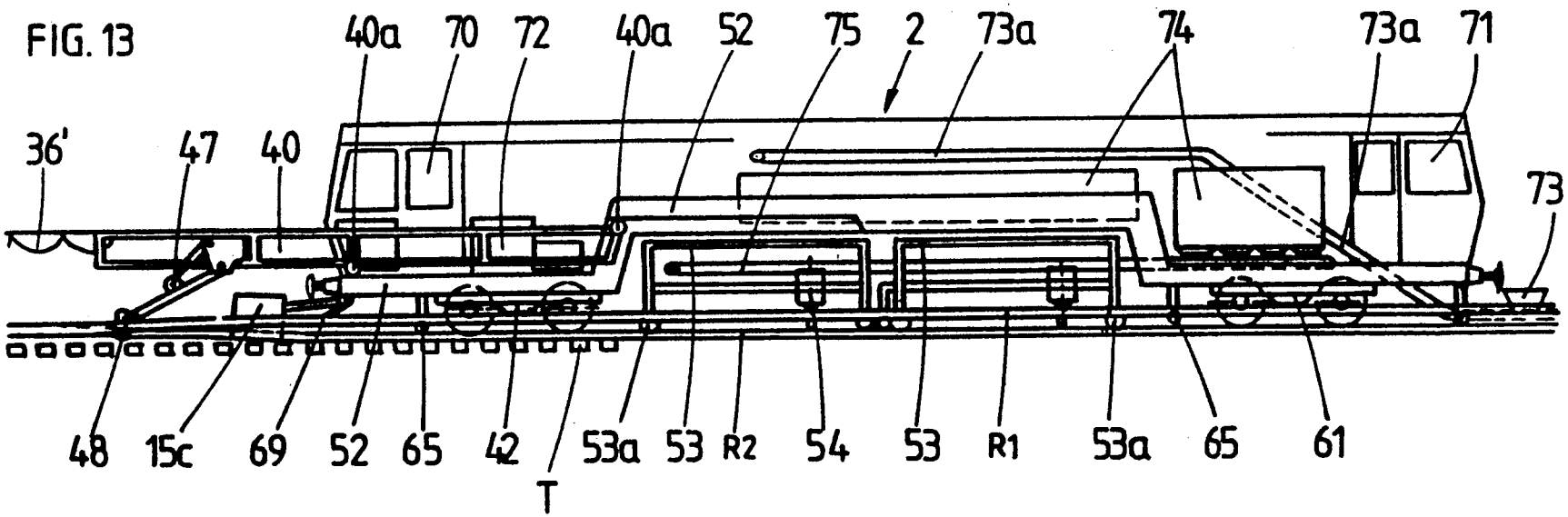

FIGS. 11 to 13 show, placed one after the other, a third embodiment of a train for substitution completed, in front of the heating vehicle 1, by a welding vehicle 80 to weld the new rails R2, before the latter are neutralised. Furthermore, the heating tunnels of the vehicle 1 are shorter and are installed lower down, such that the path of the rails R2 is located below the axles of the bogies, at a distance of between 20 to 40 cm, preferably between 25 and 30 cm, from the ballast. By virtue of this disposition, there is no need to lift the rails very high and especially above the axles, which facilitates the work and the guiding of the rails.

The parts of the heating vehicle 1 which correspond to the parts of the first example have the same reference symbols.

Vehicle 1 (FIG. 12) supplied with a leading bogie 5 and with a rear bogie 12 runs on the old rails R1 and comprises a body 4 comprising a cabin 4*a*, compartments 4*b* for inverters which supply power at high frequency to the inductors of each heating tunnel, compartments 4*c* for the refrigerator sets which cool the inductors, a tank 4*d* for the fuel oil, generator sets 4*e* that supply power to the inverters, and sets of capacitors 4*f* associated with the inductors. The new rails R2, previously deposited in the middle of the track, are caught at the front of the vehicle 1 by gripping means 14 and laid onto the guide rollers 64, which are fixed on the framework of the vehicle and distributed along the latter, in such a manner that the new rails R2 can pass beneath the axles 5*a*, 12*a* and between the wheels of the bogies 5 and 12.

Figure 14:
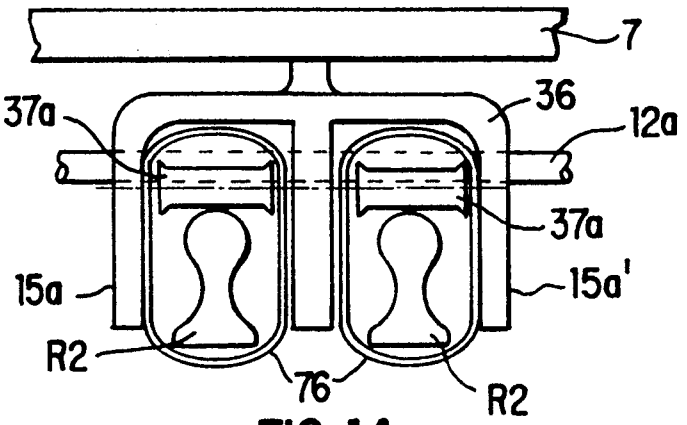
FIGS. 14 and 15 are enlarged sectional views of the tunnel for the vehicle 1 of FIG. 12 according to two different variants

The heating tunnels are installed in the zone of the rear end of the vehicle 1 in the middle of the track, in a common holder 36 (FIG. 14). For the case considered, they are divided into two parts 15*a*, 15*b* which are fixed to the framework 7, one situated before and the other after the rear bogie 12. For high-frequency heating, the part 15*a* comprises two inductor units 76, each having a length of 1 m, and therefore has a length of only 2 m, while the part 15*b* comprises only one inductor which is 1 m in length. Each inductor 76 has the form of a one-turn coil and is connected to a set of capacitors, the oscillating circuit formed by this coil and said capacitors is fed by the inverters. By virtue of the short length of the tunnel, the rails R2 are not required to be guided in the interior of the tunnel, but may pass through it freely. Of course, each part of the tunnel comprises two sections which are placed side by side, one for each stretch of rails, as shown in FIG. 14 for the parts 15*a*, 15*a*', which sections are provided with inductors 76 surrounding the two rails R2. In order to ensure a correct centred guiding, each part of the tunnels may be supplied with rollers 37*a* which bear on and run on the rails R2 passing this part, these rollers being installed before and after the inductors, respectively between the inductors. The parts of the tunnels are suspended from the framework 7 in such a manner that they are slightly movable in relation to the framework in order to allow them self-adjustment.

Figure 15:
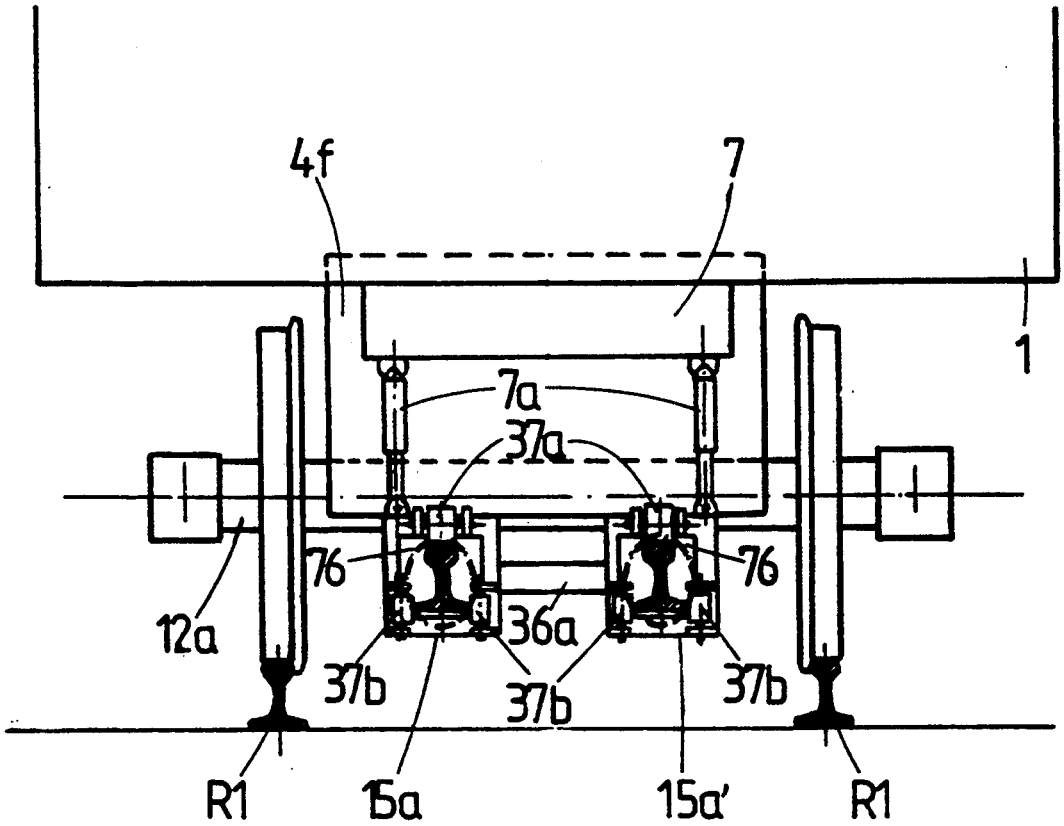

According to the variant of FIG. 15, the two sections 15*a*, 15*a*' of the tunnel provided for each stretch of rail are spaced, connected by a traverse 36*a* and suspended from the framework 7 by means of jacks 7*a* which permit to lift them when the vehicle is running light. Each tunnel is provided not only with rollers 37*a* bearing on the rails R2 but also with rollers 37*b* on both sides of each rail for the lateral guiding.

In order to detach the old rails R1, there are provided detaching units on two platforms 16 which are suspended from the framework 7; these platforms are equipped with tools for disassembling fixtures, such as automatic sleeper-screw drivers 18, and are supplied with wheels 16*a* in order to run on the rails R1.

At the rear, the vehicle 1 comprises rail-guides 29 for the old rails R1 that are released, a cantilevered frame 38 carrying an adjustable support 31 provided with rail lifters 32 which lift the rails R1 (FIG. 12) and move them apart (FIG. 12*a*), as well as a tracked conveyor 39 running on the sleepers in order to prevent them from leaving the ballast during the lifting of the rails R1. The frame 38 may be displaced towards the interior of the vehicle by virtue of the rollers 38*a* running on slide bars on the framework 7.

The assembly vehicle 2 (FIG. 13), having the bogies 42 and 61, runs on the new rails R2 which are laid in their correct position on the sleepers ahead of the bogie 42. For this purpose, the vehicle comprises, at the front, a cantilevered frame 40 supplied with an adjustable support 47 carrying rail lifters 48 for moving the rails R2 apart towards the fixing positions, as FIG. 13*a* shows. The frame 40 may be displaced towards the interior of the vehicle by virtue of the rollers 40*a* running on slide bars of the framework 52.

Below the framework 52 of the vehicle 2 are mounted an auxiliary heating tunnel 15*c*, which is positioned in front of the vehicle and covering the rails R2 from the top, and other rail lifters 69 for the positioning of these rails R2 on the sleepers T. This auxiliary tunnel 15*c* comes into operation only after an interruption in the work for reheating the rails R2 that have already left the tunnel 15*a*, 15*b* before their fixing.

A connection 36' between the vehicles 1 and 2 comprising an electrical line and a cooling duct serves to power this part 15*c* of the tunnel.

Vehicle 2 comprises moreover cabins at the front 70 and the rear 71, a generator set 72 and assembly stations on the two platforms 53. These platforms are suspended from the framework 52 and are supplied with tools for the assembly of the fixtures, especially automatic sleeper-screw drivers 54, as well as wheels 53*a* to run on the rails R2. The old rails R1 are guided by guide rollers 65 and are deposited by the side of the track as FIG. 13*a* shows.

At the rear of the vehicle 2 are provided means 73 for collecting fastenings disassembled by the detaching units of the vehicle 1 and deposited on the track. These fastenings are transported by conveyors 73*a* to storage places 74 and by conveyors 75 to the fastening units on the platforms 53.

At the front of the vehicle 1, a vehicle 80 for welding (FIG. 11) runs on the rails R1 in order to weld new rails R2 and, after having achieved a weld, advances to the place for the next weld. This vehicle 80 comprises at the front a rail crane 81, a cabin 82 and, suspended from the framework 80*a*, a unit 83 for welding by flash-butt welding, means 84 for the positioning of the rails to be welded and a grinding unit 85 for the machining of the welds. At the rear is located a generator set 86. Guide rollers 87 suspended from the framework guide the rails R2 before their positioning by the means 84 and after the welding. If the vehicle 80 is out of service, the welding unit may occupy a parked position 83' as shown by dashed lines in FIG. 11. By virtue of this vehicle 80, which works largely automatically, the new rails R2 form a joint-free stretch before passing through the vehicle 2. As shown in FIG. 11 said means 84 and the units 83, 85 are installed between the leading and rear bogies; this disposition permit a good positioning and a more rapid treating of the rails than with known welding devices.

The duration of each welding is approximately 1.5 to 2 minutes; the complete operation, including the positioning and the grinding as well as the advance of the vehicle 80, lasts approximately 18 minutes. If, for example, the rails have a length of 108 m, the train with the vehicles 1 and 2 may advance in a continuous manner at a speed of approximately 360 m/h.

In order to facilitate the manipulation of the rails R2, the latter are laid on small tracking trolleys 90 comprising a small support laid between two sleepers T and supplied with rollers, on which the rails R2 may move easily in the longitudinal direction during their positioning before the welding and thus during the welding itself until they are fixed. To this end, the new rails R2 located in front of the welding vehicle 80 are placed on the small trolleys 90 until they are taken up again by the guide rollers 87 and, beyond the vehicle 80, the rails lie once again on the trolleys 90 until they are taken up again by the guide rollers 64 of the vehicle 1. These small trolleys 90 may be stored on a support 88 at the front of the vehicle 80 and when they are no longer utilised once the rails have been taken up by the guide rollers 64 of the vehicle 1, they may be deposited on a support 79 at the front of the vehicle 2. These trolleys 90 are distributed at the front of the vehicle by a laying trolley running on the old rails R1.

As in the example according to FIG. 4, there may also be provided at the front of the vehicle 2 a welding unit for the first weld at the start of the work.

The invention is not limited to the embodiments described but may exhibit numerous variants.

I claim:

1. Device for the continuous substitution of the rails of railway tracks, comprising:

a train composed of a welding vehicle and a heating vehicle, both running on old rails with said welding vehicle running before said heating vehicle, and an assembly vehicle running on new rails;

(A) wherein said welding vehicle includes:

(1) means for positioning the new rails to be welded and previously brought to the site between the old rails, (2) at least one welding unit for welding the adjacent ends of the new rails which pass below the axles of said welding vehicle, and (3) a grinding unit, wherein said means for positioning said at least one welding unit and said grinding unit are installed between leading and rear bogies of the welding vehicle;

(B) wherein said heating vehicle includes:

(1) at least one heating tunnel for each new rail, equipped with a facility for induction heating, said tunnel being traversed continuously be the new rail during the advance of the train in order to neutralize said new rail, said heating tunnel being located between the old rails and below the body of the heating vehicle, the new rails passing below the axles and between the wheels of said heating vehicle;

(2) means for measuring and controlling the temperature of the new rails;

(3) means for gripping the new rails to introduce them into said tunnel;

(4) stations for releasing the old rails from sleepers, said stations being installed between bogies of said heating vehicle; and (5) means for guiding the old rails that are detached; and (C) wherein said assembly vehicle running on the new rails laid upon the sleepers includes:

(1) means for guiding and for laying the new rails on the sleepers, said means being disposed at a front end of said assembly vehicle, and (2) working stations for fastening to the sleepers the new rails brought to the desired temperature.

2. Device according to claim 1, characterised in that at the front of the assembly vehicle is installed an auxiliary heating tunnel.

3. Device according to claim 1, characterised in that there is provided a cantilevered frame at the rear of the heating vehicle, this frame carrying an adjustable support provided with rail lifters for guiding the rails.

4. Device according to claim 3, characterised in that the said cantilevered frames are displaceable towards the interior of the vehicle concerned.

5. Device according to claim 1, characterised in that the stations for releasing the old rails (R1) and for fastening the new rails (R2) are installed on platforms suspended from the frameworks of said vehicles in a retractable manner, which platforms are preferably disposed in order to be able to run on the old and the new rails.

6. Device according to claim 5, characterised in that the said platforms are equipped with computer-controlled robot-machines respectively for the detaching and for the automatic fastening of rail fixtures.

7. Device according to claim 1, characterised in that a transport system is provided for the conveying of fastenings, disassembled at the working stations of the heating vehicle, to the fastening stations of the assembly vehicle.

8. Device according to claim 1, characterised in that each tunnel is supplied with support or guide rollers.

9. Device according to claim 1, wherein said assembly vehicle includes at its front end a cantilevered frame having said means for guiding and for laying the new rails on the sleepers.

10. Device according to claim 1, wherein said tunnels are located in a zone of a rear end of the heating vehicle, said tunnels being divided in two parts disposed one in front of and the other after the rear bogie of the heating vehicle.

11. Device according to claim 1, wherein said tunnels are installed side by side in a single holder.

* * * * *